United States Patent [19]

Aizawa et al.

[11] Patent Number: 4,730,286

[45] Date of Patent: Mar. 8, 1988

[54] CIRCUIT AND METHOD FOR CORRECTING THE RATE OF AN ELECTRONIC TIMEPIECE

[75] Inventors: Hitomi Aizawa; Hiroshi Yabe, both of Nagano, Japan

[73] Assignee: Seiko Epson Corporation, Tokyo, Japan

[21] Appl. No.: 750,803

[22] Filed: Jul. 1, 1985

[30] Foreign Application Priority Data

Jul. 6, 1984 [JP] Japan ..... 59-140017
Feb. 18, 1985 [JP] Japan ..... 60-29837

[51] Int. Cl.[4] ..... G04B 17/20
[52] U.S. Cl. ..... 368/202; 368/200
[58] Field of Search ..... 368/200–202; 331/177 R, 179, 158, 116 R, 176

[56] References Cited

U.S. PATENT DOCUMENTS 3,568,093 3/1971 Ishida ..... 368/202
4,427,302 1/1984 Watanabe ..... 368/200
4,473,303 9/1984 Suzuki ..... 368/201
4,583,059 4/1986 Konno ..... 331/179

*Primary Examiner*—Bernard Roskoski
*Attorney, Agent, or Firm*—Blum Kaplan

[57] ABSTRACT

Rate change in a quartz crystal timepiece due, for example, to aging of a capacitance used for correcting the frequency-temperature characteristic of the crystal oscillator of the timepiece, is corrected by dividing the oscillator output signal to provide a minimum rate adjustment unit signal and a rate adjustment timing signal. A rate adjustment step width signal consisting of a number of minumum rate adjustment unit signals is predetermined for all of the timepieces in a production run. The number controls the repeated counting of unit signals to produce a series of step width signals. The rate adjustment required for correct timekeeping is determined as an integral number of step width signals. The latter number is set into a second counter in the timepiece to generate a rate adjustment signal. The rate adjustment signal controls the duty cycle of a switch which adds reactance to the crystal oscillator circuit to effect the rate change.

17 Claims, 8 Drawing Figures

FIG. 1
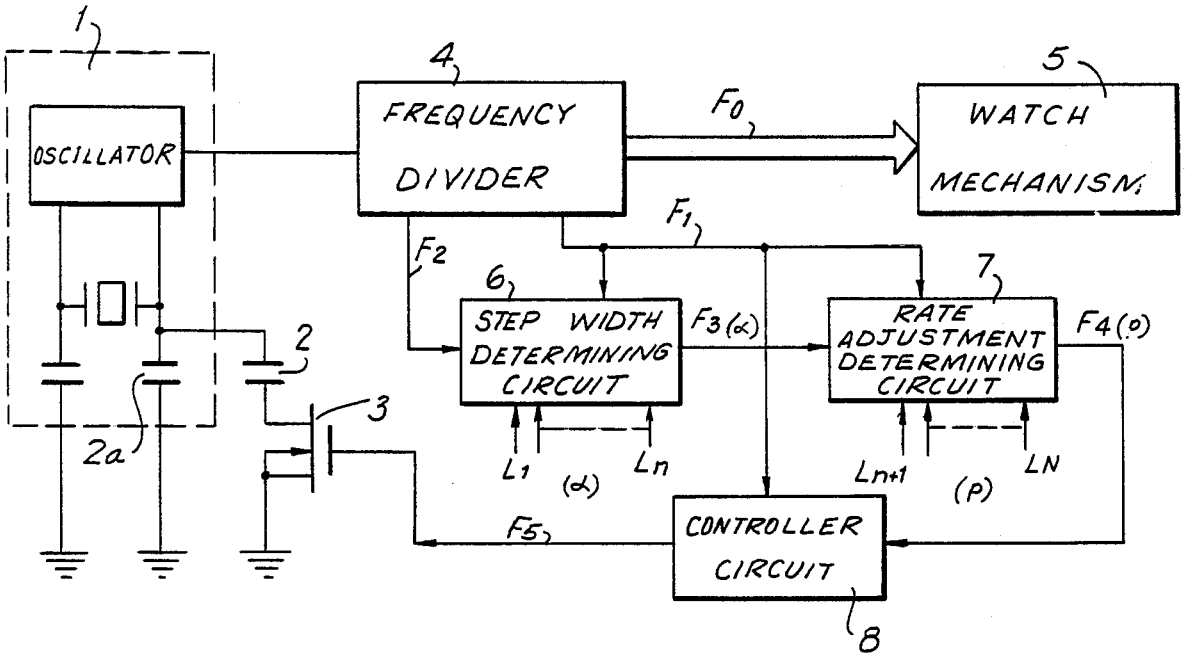
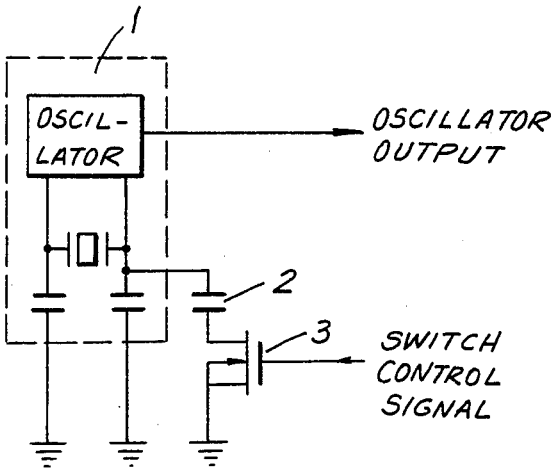
FIG. 2
PRIOR ART

CIRCUIT AND METHOD FOR CORRECTING THE RATE OF AN ELECTRONIC TIMEPIECE

BACKGROUND OF THE INVENTION

This invention relates to electronic timepieces. More particularly, the invention relates to a circuit for use in adjusting the rate of an electronic timepiece for changes due to temperature, changes and the like.

A number of methods are known by means of which the rate of a timepiece which uses a quartz crystal as a time base can be adjusted to compensate, for example, for changes in temperature. In one such arrangement, a trimmer capacitor is added to the oscillator circuit and the frequency of oscillation is varied by increasing or decreasing the capacitive reactance of the circuit. In another widely used arrangement, known as the digital tuning method, a variable divider is provided at the output of the oscillator for changing the driving rate of the timepiece.

In recent years, however, even though timepieces have become more and more precise, there remains a strong demand for even more precision, accompanied by high reliability. The achievement of this result by means of the above-described arrangements is extremely difficult.

One solution to this problem has been put forth which uses the basic circuit shown in FIG. 2 in which a frequency changing capacitor 2 is connected, via transistor switch 3, to a quartz crystal oscillator 1 which provides a standard frequency for the timepiece. The frequency of oscillation is changed by opening and closing switch 3, thereby adjusting the rate of the timepiece. Details of this method are disclosed, for example, in U.S. Pat. Nos. 3,568,093 and 4,473,303. This method is advantageous in that precise rate adjustment can be done quickly. When combined with the aforementioned digital tuning method, a rate adjustment is achieved which is effective over a wide temperature range.

However, the above method has defects of its own arising out of the fact that the capacitance of the switched capacitor is small and the capacitor is usually incorporated with the transistor switch in an integrated circuit. This results in the variation, from timepiece to timepiece, in the capacitance value realized at the time of manufacture, resulting in undesirable variations in the change in frequency of oscillation produced when the capacitor is connected to the oscillator. Thus, when the operation of the transitor switch is to be adjusted by equal adjustments of rate at the initial timing of the movement, the effect of the adjustment varies, as between individual timepieces, thereby making the rate adjustment troublesome.

The foregoing is especially true when, after distribution of the timepieces by the manufacturer, additional rate adjustment of the timepieces is required in order to compensate for the effects of aging and the like. This adjustment is difficult for the average retailer to perform since, due to the difficulty of attaching data to each individual timepiece, the necessary data for adjusting the rate has not accompanied the timepiece. Because the retailer does not know to exactly what extent the rate of the timepiece can be adjusted by the method he is accustomed to using, he must use a rate measuring device and the focusing method to bring the timepiece gradually nearer to the desired rate. The result is that, due to the generally very troublesome rate adjustment, a large amount of costly retailer time must be spent in a non-retailing activity.

Variation of the rate of the quartz crystal oscillator of FIG. 2, having a second order frequency-temperature characteristic, is illustrated in FIGS. 3(*a*) and 3(*b*). FIG. 3(*a*) shows the effect on the frequency-temperature characteristics of a timepiece when the rate-changing capacitor has too small a capacitance, while FIG. 3(*b*) shows the effect of too large capacitance, as the result of variations in manufacture, the quartz crystal oscillator otherwise having identical characteristics. The frequency-temperature curve of each timepiece, when switch 3 is open, is marked $f_0(t)$. When switch 3 is closed, the curves of frequency vs. temperature are respectively marked $f_1(t)$ and $f_2(t)$. Frequency changes $\Delta f_1$ and $\Delta f_2$ are produced by opening and closing the respective transistor switch. The amount of frequency change $\Delta f_1$ or $\Delta f_2$ is generally constant over the whole desired temperature range. If it is assumed that the rate adjustment is to be done in four adjusting steps, division of the distance $\Delta f_1$ (between peaks of the second order curves $f_1(t)$ and $f_0(t)$) into four steps, results in different step widths for the timepiece of FIG. 3(*a*) as compared to that of FIG. 3(*b*). Thus, the manufacturing variation in the capacitance of the added capacitor causes the width of one adjusting step, as between individual timepieces, to differ and makes it impossible to predict how many steps will be required for a rate adjustment. At present, therefore, the rate must be adjusted by the focusing method, as previously stated.

SUMMARY OF THE INVENTION

In accordance with the present invention, the above problem is overcome in a circuit which includes a divider which divides the output signal of the quartz crystal oscillator of the timepiece to produce a timing signal and, a reference signal for determining the smallest possible step of the rate adjustment. The circuit also includes means for determining the width of one rate-adjusting step, means for determining the number of rate adjustment steps needed to produce a desired correction in the rate of the timepiece, and a controller circuit for regulating the amount of time that a reactance element is switched into the circuit of the quartz crystal oscillator to realize the rate adjustment.

In operation, the difference between the natural oscillator output frequency and the oscillator output frequency when the reactance is added to the oscillator circuit, is divided to provide minimum rate adjustment units, with a resolution which is determined by means of the timing and the reference signals from the divider circuit. The minimum rate adjustment unit is used as a building block in the formation, by a predetermined count, of a rate adjustment step whose width is essentially constant between similar timepieces. To adjust the timepiece, the number of rate adjustment steps required to produce the desired rate is determined and the total is used to produce a cyclic rate correction signal. The rate correction signal is, in turn, fed to the controller circuit for regulating the rate of opening and closing of the switch, thereby effecting the desired rate change of the timepiece.

The circuit for accomplishing the above can utilize counters and logic elements or it can utilize a microprocessor which performs the required functions.

Accordingly, it is an object of the invention to provide a rate adjustment circuit in which the needed amount of rate adjustment for like timepieces can be specified in terms of a constant.

It is still another object of the present invention to provide a circuit for inclusion in a quartz crystal timepiece which facilitates rate adjustment of the timepiece by the retailer dealer.

It is a further object of the invention to provide a rate adjustment circuit for use in a quartz crystal timepiece which requires a simple measurement of timepiece error to establish the amount of rate correction which is needed.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF DRAWINGS

For a fuller understanding of the invention, reference is had to the following description, taken in connection with the accompanying drawings in which:

FIG. 1 is a block diagram of an embodiment of an electronic timepiece utilizing the teachings of the present invention;

FIG. 2 is a schematic diagram of a rate adjustment circuit of the prior art in which the reactance of the quartz crystal oscillator circuit is varied to change the oscillator frequency;

DETAILED DESCRIPTION OF THE INVENTION

Figure 3A:
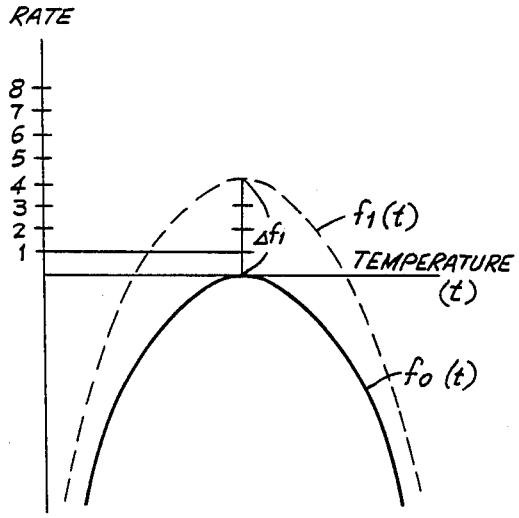
FIGS. 3(*a*) and 3(*b*) show the frequency-temperature characteristics of two quartz crystal oscillators in which the capacitance of the adjustment reactance is different due to manufacturing variations.
Figure 3B:
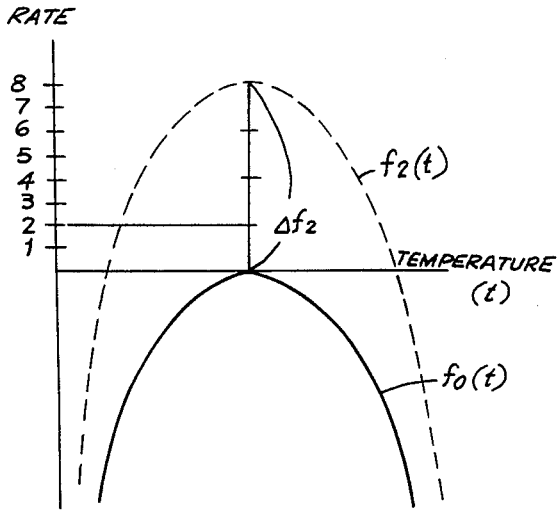

Reference is first made to FIG. 1 which is a block diagram of a rate adjustment circuit for a quartz crystal timepiece, such as a clock or a watch, in accordance with this invention. Reference is also made to FIG. 6 which shows the timing of waveforms in the circuits of FIG. 1 and 5.

In FIG. 1, a quartz crystal oscillator 1 serves as a source of a standard frequency for a timekeeping mechanism 5. The frequency of oscillation of the crystal in oscillator 1 is varied by opening and closing a transistor switch 3 which connects a capacitor 2 in parallel with a capacitor 2*a* of the oscillator circuit. The output of quartz crystal oscillator 1 is divided by a frequency divider 4 which produces standard frequency signal $F_0$ for watch mechanism 5 as well as adjustment cycle timing signal $F_1$ and reference signal $F_2$. Signal $F_1$ and $F_2$ are used in determining the timing and resolution of the rate adjustment. A step width determining circuit 6 produces a step width signal $F_{3(\alpha)}$, which represents the width of a rate adjustment step, by combining timing signal $F_1$ and reference signal $F_2$ with a value $\alpha$ which is set in on input terminals $L_1 \ldots L_n$. Step width signal $F_{3(\alpha)}$ is fed to rate adjustment circuit 7 which periodically determines the amount of rate adjustment required in accordance with a number P set in at input terminals $L_{n+1} \ldots L_N$, and provides a rate adjustment signal $F_{4(P)}$ applied to controller circuit 8. Controller circuit 8, which also receives timing signal $F_1$, forms a switch control signal $F_5$ which controls the opening and closing of transistor switch 3. Timing signal $F_5$ provides the duty cycle for the cyclic switching of capacitor 2 and thus effects the rate adjustment by varying the oscillation frequency of the quartz crystal oscillator 1.

Figure 4:
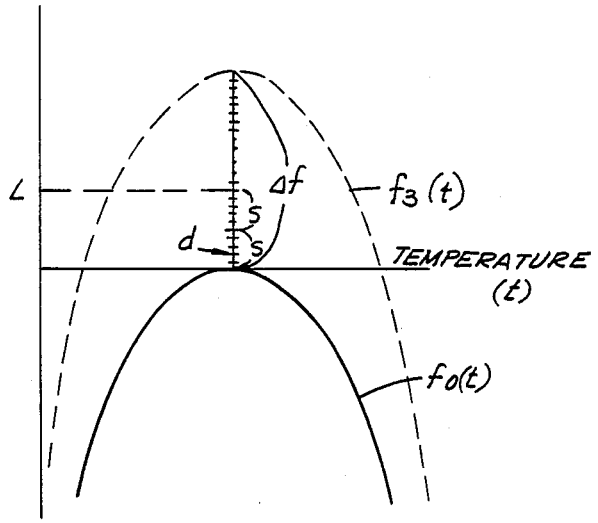
FIG. 4 is a frequency-temperature diagram used in explaining operation of the present invention.

Reference is now made to FIG. 4 for illustration of the operation of the circuit of FIG. 1 in terms of the frequency-temperature characteristic of a quartz crystal oscillator. The unit of resolution d of FIG. 4 is determined by means of timing signal $F_1$ and reference signal $F_2$ of FIGS. 1 and 6 as a function of the frequency deviation $\Delta f$. Given the signal $F_1$ for determining the frequency of the rate adjustment cycle and the reference signal $F_2$, the minimum rate adjustment unit d for switching capacitor 2 is expressed as follows:

$$d = \Delta f \cdot \frac{F_2^{-1}}{F_1^{-1}}$$

where $F^{-1}=1/F$. The width S of a rate adjusting step is defined as $S=\alpha \cdot d$. Rate adjustment determining circuit 6 performs the calculation $S=\alpha \cdot d$. Since, for the circuit of a given timepiece, the value of $\alpha$ is constant, the value of d varies with $\Delta f$. The step width value S can therefore be made constant from mass-produced watch to mass-produced watch by adjustment of the coefficient $\alpha$.

In order for the rate adjustment to have the necessary precision, an arbitrary $\Delta f$ is selected at the time of the manufacture which accomodates the full range of manufacturing variation in capacitor 2. Also, the unit of resolution d is made sufficiently small that the required step width S, can be met by an integer coefficient $\alpha$. Thus, when a series of timepieces is run off in the manufacturing process, $\Delta f$ is measured to determine d and to calculate the integer coefficient $\alpha$ necessary to produce step width S. The coefficient $\alpha$ can be set into the step width determining circuit 6 of an individual timepiece. In this manner, same rate adjusting step width S will be common to all of the timepieces in the run. Since the width of the rate adjustment step is the same for all timepieces of a given production run, the retailer can easily determine and set in the necessary number of steps to adjust the rate of a particular timepiece.

Given a required adjustment L (FIG. 4), the number of steps P which satisfies the relation $L=P \cdot S$ is set into rate adjustment determining circuit 7 which calculates, using the predetermined value of P, the total amount of adjustment required. Thus, by providing a predetermined value of P to the retailer, the retailer can easily and speedily complete the rate adjustment.

The controller circuit 8 of FIG. 1 produces rate adjustment control signal $F_5$ as called for by timing signal $F_1$, taking into account the value of total rate adjustment $F_{4(P)}$ as calculated in rate adjustment determining circuit 7.

Figure 5:
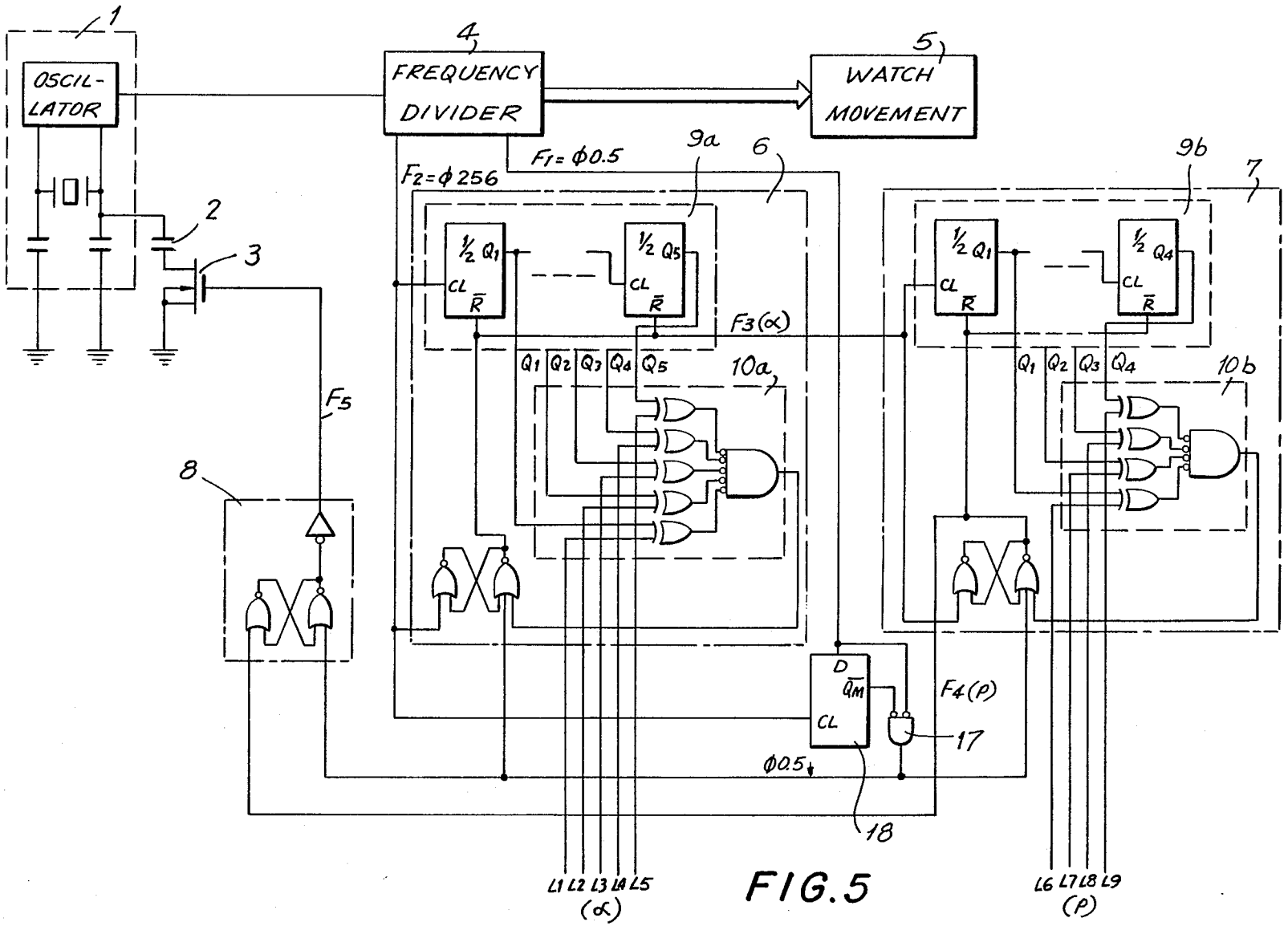
FIG. 5 is in part a block diagram and in part a circuit diagram showing are embodiment of the rate adjustment circuits in accordance with the invention.
Figure 6:
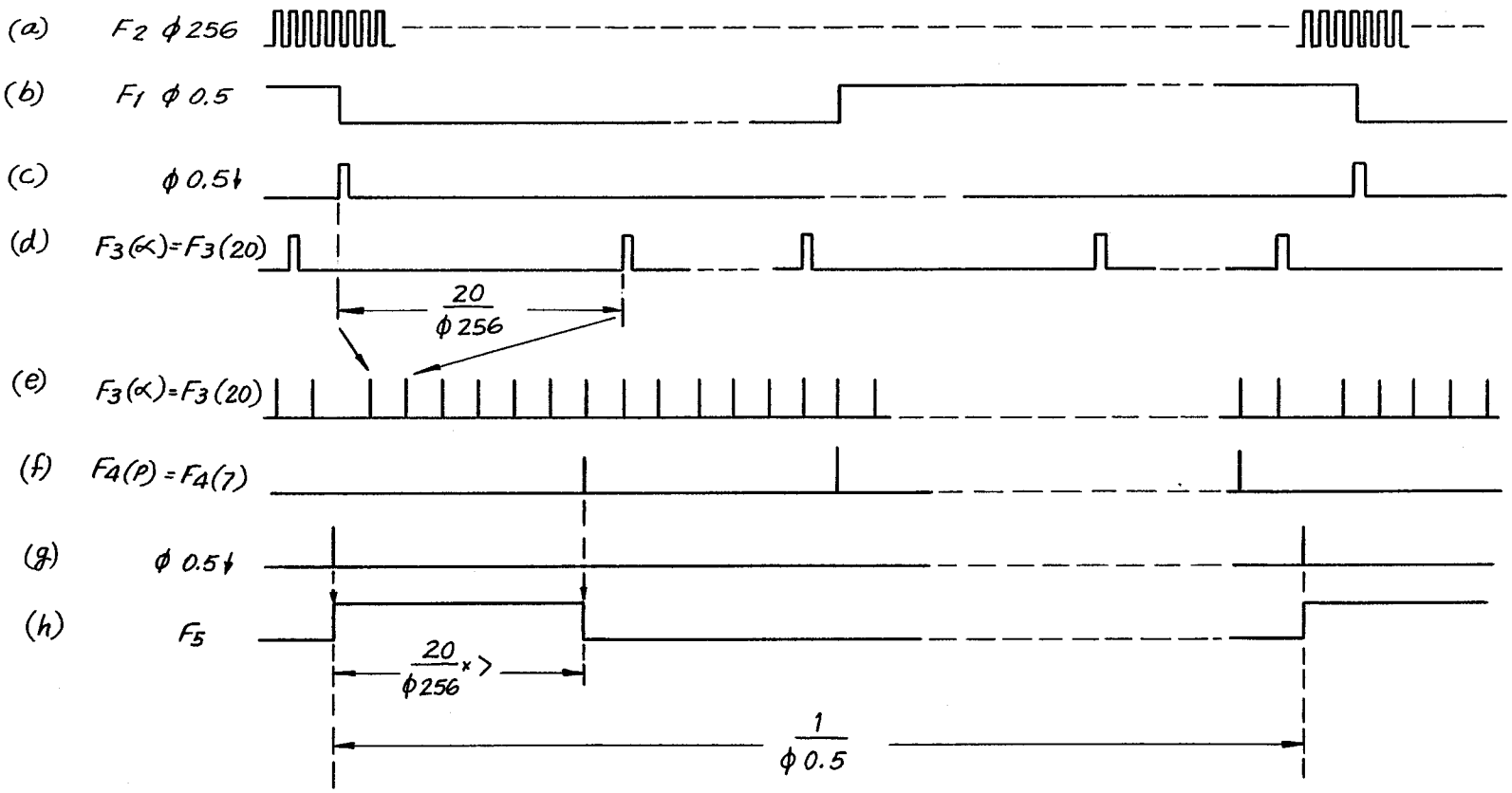
FIG. 6 is a chart showing the timing of signals in the circuit of FIG. 5.

FIG. 5 shows the circuit of FIG. 1 in detail, and FIG. 6 shows the timing of signals used in the circuit of FIG. 5. In FIG. 5, each block which is numbered 1 to 8, including those surrounded by chain lines, corresponds to the block which has the same reference numeral in FIG. 1. Step width determining circuit 6 and total rate adjustment determining circuit 7 each respectively include a binary counter 9a or 9b and a coincidence detector 10a or 10b. The associated respective binary counters 9a, 9b, coincidence detector circuits 10a, 10b, and inputs $L_1$–$L_5$ (for step width coefficient $\alpha$), $L_6$–$L_9$ (for the number of steps P), constitute variable divider circuits whose dividing ratios are dependent upon which associated terminal L is selected. The inputting of coefficients $\alpha$ and P, on lines $L_1$–$L_5$ and $L_6$–$L_9$ can be done by means of switches (not shown) in a manner well known in the art.

Binary counter 9a is clocked by reference signal $F_2$ ($\phi$256) shown in waveform (a) of FIG. 6. Counter 9a is reset when the count reaches the value of $\alpha$ as set on lines $L_1$–$L_5$, as determined by coincidence circuit 10a. Binary counter 9a is also reset by a pulse signal ($\phi$0.5 ↓), respresentative of the negative excursions of the timing signal $F_1$ ($\phi$0.5). Pulse signal $\phi$0.5 ↓ (shown in waveforms (c) and (g) of FIG. 6 to different scales) is produced by D-type flip-flop 18 and gate 17 from timing signal $F_1$ (shown as waveform (b) of FIG. 6) and reference signal $F_2$. In this manner, a rate adjustment cycle starts over each 2 seconds. The reset of counter 9a by signal $F_{3(\alpha)}$ (shown in waveforms (d) and (e) of FIG. 6 to different scales) clocks counter 9b. Counter 9b is reset when the count reaches the value P as set on lines $L_6$–$L_9$, as determined by coincidence circuit 10b. Counter 9b is also reset by pulse signal $\phi$0.5 ↓. The reset signal $F_{4(P)}$ for counter 9b (shown in waveform (f) of FIG. 6) serves to terminate rate adjustment for the 2 second period by turning controller circuit 8 off. The controlling circuit was turned on by the pulse of signal $\phi$0.5 ↓. Transistor switch 3 is thus turned on for a period represented by signal $F_5$ shown in waveform (h) of FIG. 6.

The minimum rate adjustment unit d of the illustrative embodiment of FIGS. 5 and 6 is given by the formula:

$$d = \Delta f \cdot \frac{\frac{1}{F_2}}{\frac{1}{F_1}} = f \cdot \frac{\frac{1}{\phi 256}}{\frac{1}{\phi 0.5}}$$

and accordingly, the frequency change $\Delta f$ is divided into 512 parts. Thus, when $\Delta f$ is 0.25 sec/day, d is 0.0004 sec/day. If the desired single step width S for a rate adjustment of the desired precision is 0.008 sec/day, the value for $\alpha$ is 20, derived from 0.008 divided by 0.0004. Here the value d is expressed as $1/\phi 256$ in 2 sec. That is, the adjusting amount d is obtained when switch 3 is closed for a period of $1/\phi 256$ sec in each 2 seconds. Given that the signal representing the rate adjusting width S is $1/F_{3(\alpha)}$, the equation:

$$\frac{1}{F_{3(20)}} = 20 \cdot \frac{1}{\phi 256}$$

is obtained. Converting this into frequency, $$F_{3(20)} = \frac{1}{20} \cdot \phi 256$$

Thus $F_{3(20)}$ is obtained by dividing $\phi$256 by 20.

When $\alpha = 20$ is set by binary code into the terminals $L_1 \ldots L_5$ of step width determining circuit 6, the latter acts as a vicesimal (20's) counter and presents the desired output value of $F_{3(20)}$. Therefore, even if the frequency change $\Delta f$ varies as a result as a change in capacitance of capacitor 2 so that the value of $\alpha$ is changed, a desired value of $F_{3(\alpha)}$ can be obtained by determining in the manner set forth.

When the calculated value of $\alpha$ is not an integer, the value must be rounded to the nearest whole number. However, when the error caused by such an operation is too large to be ignored in light of the desired precision, the resolution effected by the value d is raised by increasing the difference between frequencies $F_1$ and $F_2$ until the error becomes tolerable. The bit count of step width determining circuit 6 is also increased, thereby increasing the resolution.

As explained above, by calculating $\alpha$ and setting it into step width determining circuit 6 in the manufacturing process, a common rate adjustment can be determined for all timepieces in the same manufacturing line.

Using the example mentioned above, and given a step width value S=0.008 sec/day, if the necessary rate adjustment L is 0.0565 sec/day, the number of required adjusting steps derived from the equation L=P·S is equal to 7. Accordingly, by entering the number 7 in digital form into inputs L6 to L9 of rate adjustment determining circuit 7, the needed adjusting correction $F_{4(P)}$ can be obtained as:

$$F_{4(7)} = \frac{1}{7} F_{3(20)}$$

in the same manner as was the case with step width determining circuit 6.

The output of controller circuit 8 is a switch control signal $F_5$ which represents the ratio of $F_{4(P)}$, obtained as above, and timing signal $F_1$. Switch control signal $F_5$ controls the operation of transistor switch 3, operating at a duty cycle which realizes the necessary rate adjustment.

The structure of the system of the present invention is not limited to the embodiment described above but also includes for example, embodiments in which step width circuit 6 and rate adjustment circuit 7 employ countdown counters and are provided with the same input terminals. Also, it is to be understood that, if the operational delay in controller circuit 8 is large, the design of the circuit must take the delay into account.

Figure 7:
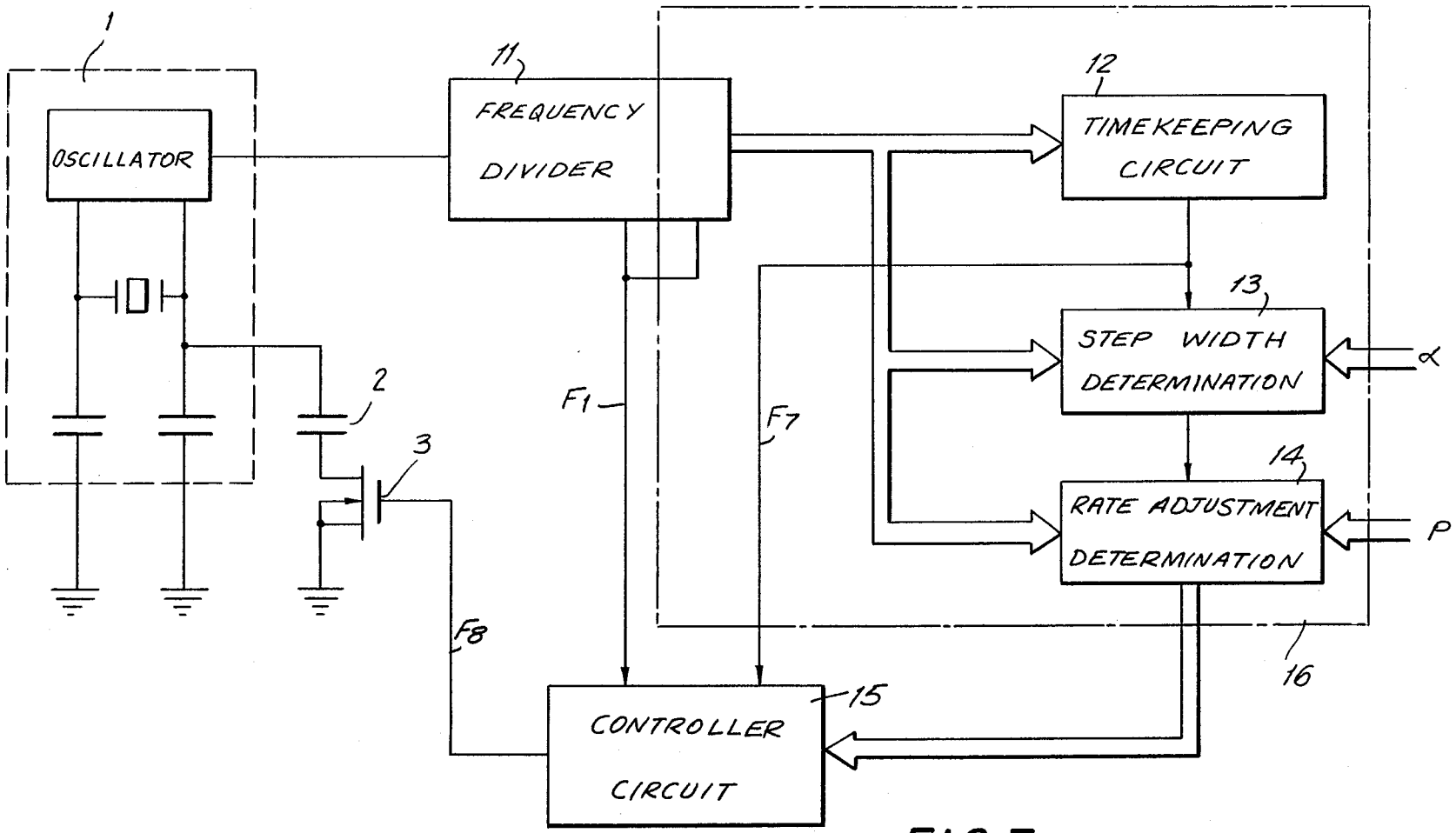
FIG. 7 is a block diagram of a second embodiment of an electronic timepiece in accordance with the present invention.

FIG. 7 is a block diagram of another embodiment of the invention in which the functions set forth above are carried out in a microprocessor. In FIG. 7, the portion of the block diagram which is enclosed by chain line 16 exemplifies functions which are effected by the microprocessor and its software.

Quartz crystal oscillator 1 supplies a standard time frequency signal and the frequency of oscillation of the crystal can be varied by opening and closing transistor switch 3 to connect capacitor 2 to the oscillator in the same way as in FIG. 1. Frequency divider 11 divides the output of quartz crystal oscillator 1 to provide the standard time signal used for the system and to produce a signal $F_6$ which is one of the signals used in determining the resolution of the rate adjustment. Frequency divider 11 may be constructed of random logic circuits or the microprocessor may be instructed to perform the division in accordance with a predetermined program.

The standard time frequency signal is fed to a timekeeping circuit 12 which provides the basic timekeeping function and may also include a timer function, a stop watch function, or other optional functions known in the art. Timekeeping circuit 12 also generates a signal $F_7$ for use in determining the resolution and synchronization of the rate adjustment. Timekeeping circuit 12 and at least a part of frequency divider 11 may be incorporated in one circuit. Accordingly, signal $F_7$ can be generated either by timekeeping circuit 12 or frequency divider 11.

In performing step width determination 13, the microprocessor determines amount of the rate adjustment by calculating the width of a single adjustment step, with a resolution determined by timing signal $F_6$ and signal $F_7$. The value for determining the step width is input externally. Rate adjustment determination 14 calculates the amount of the total adjustment using the calculated step width and the externally inputted value P which specifies the needed number of adjustment steps. Controller circuit 15 outputs a switch control signal $F_8$ for cycling transistor switch 3 open and closed, in accordance with the total rate adjustment calculated in rate adjustment determination 14 and in response to signals $F_6$ and $F_7$. The frequency of ocillation of quartz crystal 1 is thereby changed, effecting the rate adjustment.

Operation of the embodiment of FIG. 7 is described below, with reference to FIG. 4. Here the adjustment unit d is determined as follows:

$$d = \Delta f \cdot \frac{F_6}{F_7}$$

where signals $F_6$ and $F_7$ are cyclic signals and the equation of the temperature-frequency curve is second order. Signal $F_7$ determines the timing cycle for opening transistor switch 3 and signal $F_6$ establishes the minimum time unit used for controlling the opening and closing of transistor switch 3. Rate adjusting step width S is again expressed by $S=\alpha \cdot d$ and the determination 13 of the value of S is performed by the computer program. Due to the construction of the system, the value $\alpha$ is a constant and the value of d varies with that of $\Delta f$. However, the value of S can be made a constant by varying the coefficient $\alpha$. In the manufacturing process, the value d is obtained from measurement of $\Delta f$, the value of $\alpha$ which produces the desired value S is calculated for a particular timepiece ($\alpha=4$ in this embodiment, for example) and the value $\alpha$ is then set in for use in step width determination. The adjusting amount for one step is thus almost the same for all timepieces produced by the same manufacturing line.

Moreover, this embodiment teaches S can be made constant by changing other values in $S=\alpha \cdot d$. Thus, the effects of the invention may be arrived at by changing the values of any one of the signals $F_6$, $F_7$ or of $\alpha$, placing a very small burden on the system. Once the width of one adjusting step is determined, one can easily determine how many of the steps are needed for correcting the rate of the timepiece. That is, given a desired rate-adjusting correction (FIG. 4), a value of P which satisfies the equation $L=P \cdot S$ is input into the rate adjusting amount determination 14. This will result in carrying out the above calculation in the computer according to the predetermined program to provide the needed amount of rate adjustment.

Controller means 15 generates a switch control signal $F_8$ which keeps transistor switch 3 open for a period of $\alpha \cdot PF_6$ seconds each $F_7$ seconds, when the total amount of adjustment needed has been calculated in rate adjustment determination 14. Controller circuit 15, may, for example, be a pre-set count-down counter.

As previously mentioned, when the value $\alpha$ is set in at the time of manufacture and the value P is released with the timepiece, the rate adjustment can be performed easily and speedily by the average retailer.

To summarize, even when there is a manufacturing variation in the capacitance of capacitor 2 which is used to vary the frequency of a time-keeping oscillator 1 by means of a switch 3, a normalized step width for performing rate adjustment in the form of a single constant can be formed in a suitable counter circuit 6 or in a microprocessor which performs a step width determining function. The retailer can then set in the approximate number of the steps to provide the required total adjustment. The amount of rate adjustment as determined in rate adjustment circuit 7 or by rate adjustment determination 14 is fed to controller circuit (8 or 15) to automatically generate a switch control signal $F_3$ or $F_8$ which opens and closes a transistor switch 3, thereby performing the rate adjustment. Thus, the retailer need only determine and input the adjusting step number P, taking into account the width of one rate adjustment step as previously determined by the manufacturer, and the required total amount of adjustment, without regard to the individual manufacturing variation in each timepiece, is accomplished.

Furthermore, since the minimum resolution is determined only by the ratio of the signals $F_1$ to $F_2$ or $F_6$ to $F_7$, the minimum adjustment amount can be made very small. Thus, when the teachings of the present invention are used together with the conventional digital method of correcting the frequency-temperature characteristic of a timepiece by changing the dividing rate of the divider, the method for setting in the rate adjustment correction will appear to be the same as that of the general digital tuning method, when viewed from outside of the timepiece, except that only the number of setting bits is increased. Moreover, using the simple operation described above, the rate of the timepiece can be adjusted to a high degree of precision which cannot be attained when the general logic tuning method is used. The present invention is also advantageous to the retailer in the after-market service of timepieces in which the invention is embodied.

It will thus be seen that the objects set forth above, among those made apparent from the preceding description, are efficiently attained and, since certain changes may be made in carrying out the above methods in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A circuit for use in correcting the rate of an electronic timepiece, the rate adjustment circuit comprising:

quartz crystal oscillator means having a standard frequency signal for a timepiece as an output;

reactance means adapted to be coupled to the oscillator means for changing the frequency of the output signal;

switch means responsive to a control signal for coupling the reactance means to the oscillator means to effect a change in rate of the electronic timepiece;

divider means having the output of the quartz crystal oscillator means as an input and having a minimum rate adjustment unit signal as an output;

means having the minimum rate adjustment signal as an input and responsive to the input of a first predetermined number for providing a rate adjustment step width signal comprising a first predetermined number of minimum rate adjustment unit signals;

means having the rate adjustment step width signal as an input and responsive to the input of a second predetermined number for providing a rate adjustment signal comprising a second predetermined number of rate adjustment step width signals; and controller means responsive to the rate adjustment signal to provide the control signal for coupling and decoupling the reactance means to the oscillator means, whereby the rate adjustment is effected by the operation of the switch means.

2. The rate adjustment circuit of claim 1 in which the reactance means comprises a capacitor.

3. The rate adjustment circuit of claim 1 in which the switching means comprises a transistor.

4. The rate adjustment circuit of claim 1 in which the divider means comprises a counter.

5. The rate adjustment circuit of claim 1 in which the means for providing a rate adjustment step width signal further comprises:

a counter means having the minimum rate adjustment unit signal as clock input; and a coincidence detector means coupled to the counter means, the counter means being reset in response to a signal representing the predetermined number which is fed into the coincidence detector means.

6. The rate adjustment circuit of claim 5 in which the means for providing a rate adjustment signal further comprises:

a second counter means having the rate adjustment step signal as a clock input; and a second coincidence detector means coupled to the second counter means, the second counter means being reset in response to a signal representing the second predetermined number which is fed to the second coincidence detector means, the resetting of the second counter means producing the rate adjustment signal.

7. The rate adjustment circuit of claim 6 in which the divider means has an adjustment cycle timing signal as an output for application to the means for providing a rate adjustment step width signal, to the means for providing a rate adjustment signal, and to the controller means, for starting the rate adjustment cycle.

8. The rate adjustment circuit of claim 7 wherein the resolution of the rate adjustment is determined by the ratio of the adjustment cycle timing signal to the minimum rate adjustment unit signal.

9. The rate adjustment circuit of 1 in which the means for providing a rate adjustment signal further comprises:

a counter means having the rate adjustment step signal as an input; and a coincidence detector means coupled to the counter means, the counter means being reset in response to a signal representing the second predetermined number which is fed to the coincidence detector means, the resetting of the counter means producing the rate adjustment signal.

10. The rate adjustment circuit of claim 1 in which the controller means comprises logic means having the rate adjustment signal and the timing signal as inputs and in which the control signal output comprises a duty cycle which effects cyclic operation of the switch means.

11. The rate adjustment circuit of claim 1 in which the means for providing a rate adjustment step width signal further comprises:

processor means having the minimum rate adjustment unit signal and the predetermined number as inputs.

12. The rate adjustment circuit of claim 11 in which the means for providing a rate adjustment signal further comprises:

processor means having the rate adjustment step width signal and the second predetermined number as inputs.

13. The rate adjustment circuit of claim 1 in which the means for providing a rate adjustment signal further comprises:

computer means having the rate adjustment step width signal and the second predetermined number as inputs.

14. The rate adjustment circuit of claim 1 in which the divider means has a timing signal as an output and in which the means for providing the rate adjustment step signal, the means for providing a rate adjustment signal, and the controller means each has the timing signal as an input for synchronizing operation with the operation of the controller means.

15. The method of adjusting the rate of an electronic timepiece to compensate for the effects of aging and the like, the timepiece having a quartz crystal oscillator which provides a standard frequency signal for driving the timepiece, a reactive circuit component for changing the frequency of oscillation of the timepiece from the standard frequency to a second frequency, and a switch for coupling the reactive circuit component to the oscillator, the method comprising the steps of:

dividing the standard frequency signal output of the quartz crystal oscillator to provide a minimum rate adjustment unit signal;

counting a predetermined number of the minimum rate adjustment unit signals to provide a rate adjustment step width signal;

determining the number of rate adjustment step width signals required to effect the needed rate adjustment of the timepiece; and effecting a rate adjustment of the timepiece by closing the switch to change the oscillator output signal to the second frequency for the period of time established by said number of adjustment step width signals.

16. The method of adjusting the rate of an electronic timepiece of claim 15 and comprising the further step of:

dividing the standard frequency signal output of the quartz crystal oscillator to provide a timing signal; and closing the switch to effect the rate adjustment at periodic intervals defined by the timing signal.

17. The method adjusting the rate of an electronic timepiece of claim 16 and further comprising:

synchronizing the steps of providing a rate adjustment step width signal and of determining the required number of step width signals with the closing of the switch.

* * * * *